United States Patent [19]

Germain

[11] 4,198,994

[45] Apr. 22, 1980

[54] DEVICE FOR MOUNTING ROLLERS IN A MACHINE FOR TREATING METAL SHEETS OR THE LIKE

[75] Inventor: Alfred M. J. Germain, Grande Synthe, France

[73] Assignee: Union Siderurgique du Nord et de l'Est de la France (USINOR), Paris, France

[21] Appl. No.: 974,015

[22] Filed: Dec. 28, 1978

[30] Foreign Application Priority Data

Dec. 30, 1977 [FR] France ..... 77 39836

[51] Int. Cl.[2] ..... B08B 3/04

[52] U.S. Cl. ..... 134/122 R; 29/116 AD; 100/171; 266/115

[58] Field of Search ..... 266/102, 111-115; 134/64 R, 64 P, 83, 122 R, 122 P, 134, 154, 183, 199; 68/244; 29/116 AD; 100/93 RP, 153, 168-171

[56] References Cited

U.S. PATENT DOCUMENTS

| | | | |
|---|---|---|---|
| 1,271,888 | 7/1918 | Gossett et al. | 100/169 UX |
| 3,460,551 | 8/1969 | Hamilton et al. | 134/122 R |
| 3,575,100 | 4/1971 | Krause | 134/64 P |
| 3,885,581 | 5/1975 | Dahan et al. | 134/122 R |
| 3,921,514 | 11/1975 | Biondetti | 100/170 X |

FOREIGN PATENT DOCUMENTS

| | | | |
|---|---|---|---|
| 40-5835 | 2/1965 | Japan | 29/116 AD |

*Primary Examiner*—Robert L. Bleutge

*Attorney, Agent, or Firm*—Cushman, Darby & Cushman

[57] ABSTRACT

The device enables the machine to undergo without damage the passage of deformed metal sheets or metal sheets whose thickness exceeds the gap between the rollers of the machine. For this purpose, the upper rollers carried by an upper frame of the machine are mounted in bearings which are supported elastically by means of spacer blocks. Sealing elements operating under conditions particular to each sealing element are provided. The main application of this device is in machines for effecting an accelerated cooling or hardening of metal sheets.

13 Claims, 2 Drawing Figures

DEVICE FOR MOUNTING ROLLERS IN A MACHINE FOR TREATING METAL SHEETS OR THE LIKE

Figure 1:
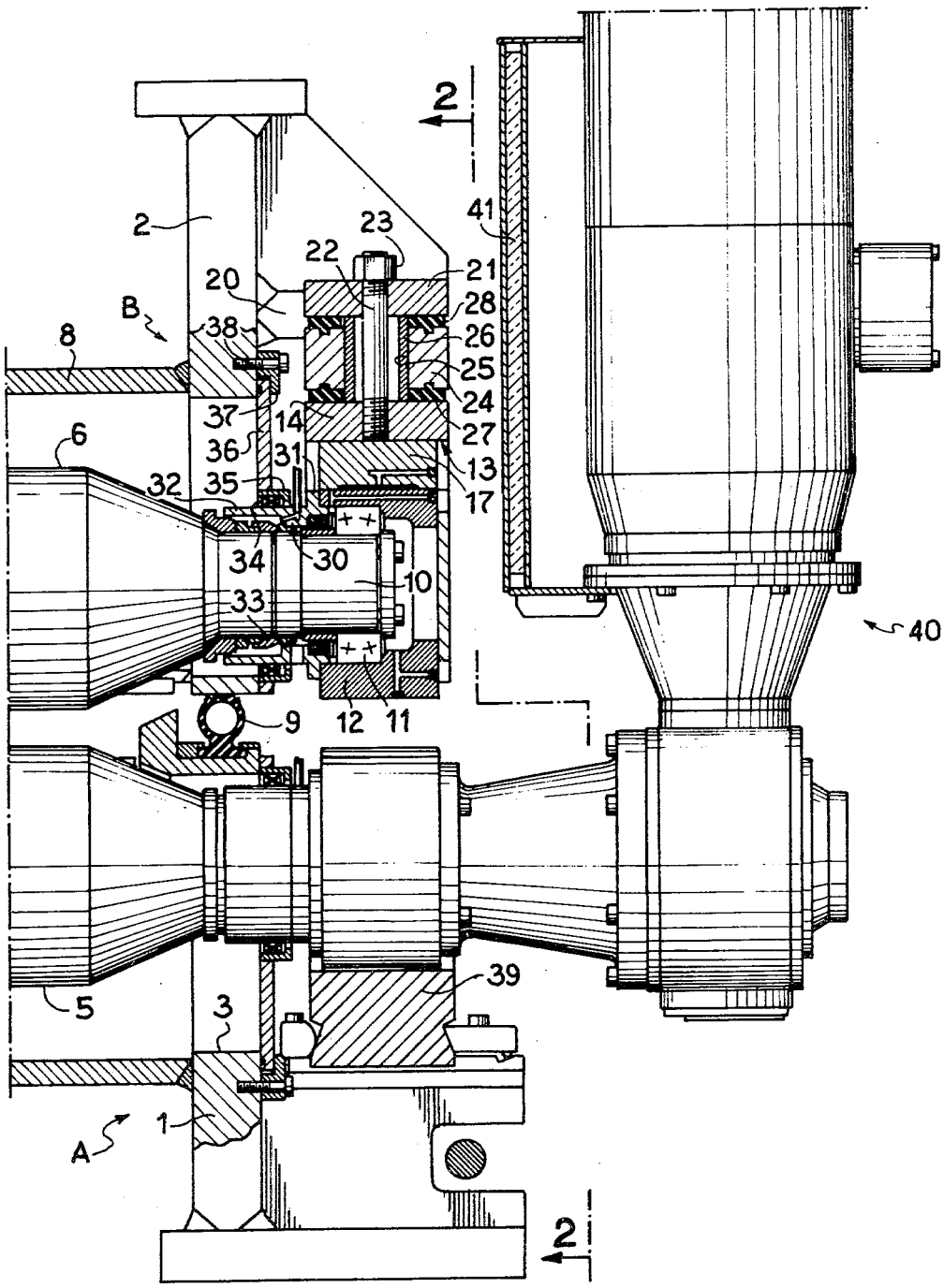

The present invention relates to a machine for treating metal sheets or like products and in particular to a machine for effecting an accelerated cooling, such as that disclosed in U.S. Pat. No. 3,885,581, and comprising a closed enclosure through which the metal sheet travels while it is guided and driven by the rollers and in which flows, in a direction parallel to the plane of the sheet, a sheet of cooling water.

Such a machine comprises a fixed lower frame carrying a series of lower rollers and an upper frame carrying a series of upper rollers and capable of moving vertically relative to the lower frame. The displacement of the upper frame enables the distance between the sets of rollers to be adjusted either for adapting the machine to a metal sheet of given thickness or for enabling the machine to operate merely as a roller table if it does not have to perform its cooling function. However, it could happen, owing to an operating error or a deformation of the metal sheet, before or during treatment, that this sheet might have a thickness exceeding the gap between the sets of rollers so that considerable forces are liable to be created which might damage the machine.

Bearing in mind the difficulties and loss of time resulting from repairs, this type of incident must be avoided. Consequently, an object of the invention is to provide a mounting of the rollers, and in particular the upper rollers, which enables a certain variation in the thickness of the metal sheet to be withstood by the whole of the machine without damage to the latter. Another object of the invention is to achieve an effective seal between the rollers and the frame on which they are mounted, this problem being moreover related to the preceding problem since a certain latitude in the distance between the upper and lower rollers substantially complicates this question of sealing.

According to the invention, there is provided a device for mounting rollers in a machine for treating metal sheets and in particular in a cooling machine, comprising a lower frame and an upper frame each of which frames carries a series of rollers, wherein the rollers of at least one series are journalled in bearings carried by supports which are connected to the corresponding frame by an elastically yieldable assembly which allows a vertical movement to a given extent.

According to other features of the invention:

only the rollers carried by the upper frame are mounted to be elastically movable;

each frame of the machine has lateral walls formed by thick plates in which openings are provided for the passage of the rollers, the bearings of the rollers and their supports being disposed outside the machine;

two sealing devices are provided for each roller, one being disposed between the roller and an element rigid with the support of the roller and ensuring the seal as concerns rotation, and the other being disposed between said element rigid with the support of the roller and an element rigid with the frame and ensuring the seal while being subjected to possible movements in translation undergone by the roller and its support;

the bearing boxes of the upper rollers are fixed in fork members which are suspended from elements of the upper frame with interposition of elastically yieldable spacer blocks which are pre-stressed.

Figure 2:
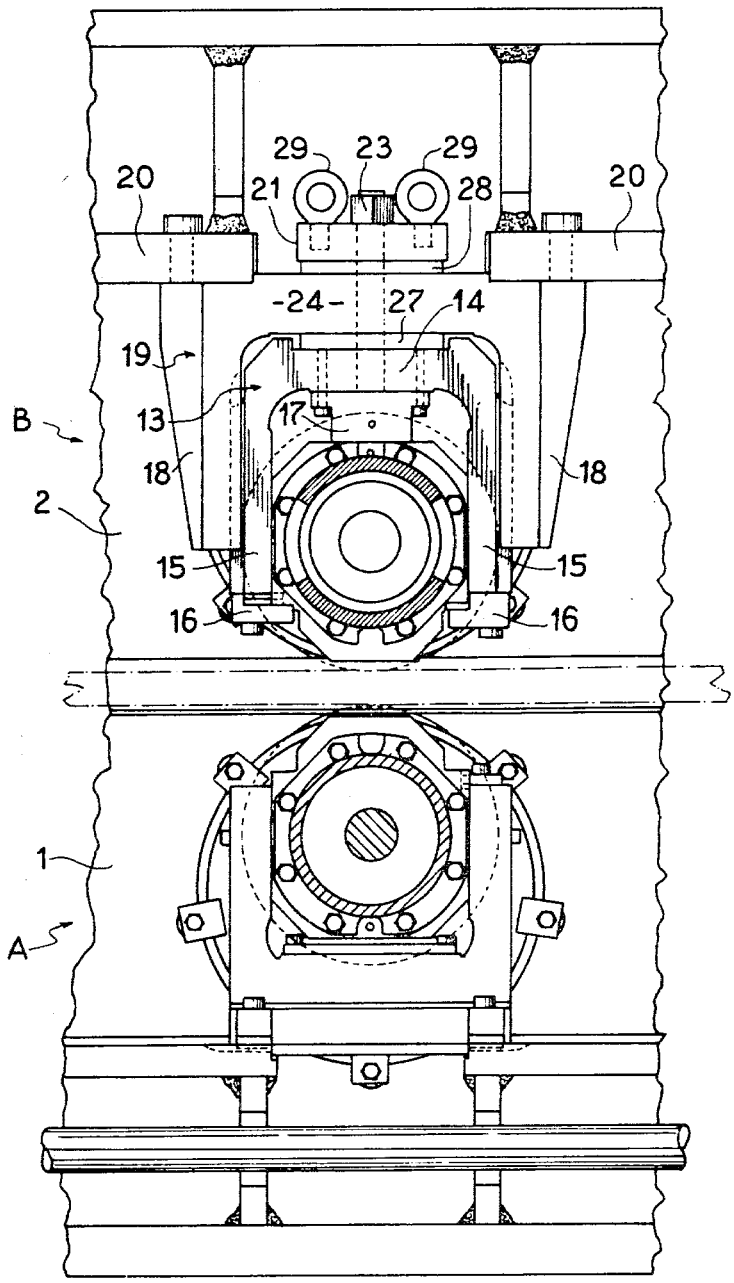

The invention will be described in more detail hereinafter with reference to the accompanying drawings which are given merely by way of example and in which:

FIG. 1 is a cross-sectional view of a part of a cooling machine including an arrangement according to the invention, and FIG. 2 is a side elevational view partly in section taken on line 2—2 of FIG. 1.

There has been shown a part of a rapid or accelerated metal sheet cooling machine of the general type disclosed in French Pat. No. 73 10 710 of the applicant. Such a machine comprises a closed enclosure which surrounds rollers driving and guiding the metal sheet and in which cooling liquid is made to flow.

This machine comprises a lower frame A and an upper frame B, the upper frame being vertically movable by means which are not shown in the drawing. Each of these frames comprises on each side of the machine a lateral wall 1, 2 formed by a thick plate, and openings 3, 4 are formed in these walls for the passage of the guide rollers 5, 6 which are surrounded by a case 7, 8. A sealing element 9 extends throughout the length of the machine and is fixed to the upper edge of the lower lateral plate 1 and is applied against the adjacent face of the lateral plate 2 of the upper frame.

There will now be described in more detail the arrangement by which an upper roller is mounted which incorporates the essential novel features of this invention.

The roller 6 is journalled by a journal 10 in a bearing 11 formed in the presently described embodiment by a self-aligning rolling bearing having two rows of rollers, this bearing being disposed in a housing 12 which is fixed in a support device comprising a first fork member 13 which has a web 14 and two lateral branches 15. The housing guided between the branches 15 is blocked by fasteners 16 which are fixed to the ends of the branches of the fork member and an intermediate block 17 is interposed between the housing and the inner end of the fork member. The latter is received between the two branches 18 of a second fork member 19 fixed to cross-members 20 which are part of the upper frame.

The first fork member 13 constitutes with an upper plate 21, to which it is connected by a screwthreaded rod 22 and a nut 23, a moving unit suspended from the second fork member 19. For this purpose, the latter comprises at the inner end thereof, 24, a bore 25 through which the rod 22 extends and through which a sleeve 26 extends which forms a spacer member between the upper face of the first fork member and the lower face of the plate 21. Two elastically yieldable blocks 27, 28 are interposed, on one hand, between the upper face of the first fork member and the lower face of the second fork member and, on the other hand, between the upper face of the second fork member and the lower face of the plate 21. These blocks may be formed by a single block or a series of washers of elastomer or other elastically yieldable material which are stacked one on top of the other. The dimension of the spacer member 26 is so chosen as to determine an axial pre-stressing or prior load exerted on the blocks 27, 28.

The upper plate 21 may carry hoisting rings 29 shown in FIG. 2.

FIG. 1 shows that the bearing housing or box 12 is extended in the direction of the machine by a ring 30 comprising a radial flange 31 by which it is fixed to the housing and a skirt 32 which is coaxial with the roller and extends alongside the journal of the roller so as to define therewith a radial gap.

The cooling enclosure is sealed in this region by means of two separate devices each of which is of known type in its practical realization and is arranged in a special way in this application. Thus, a first sealing element 33 is disposed between the journal of the roller and the ring 30, this element being of conventional construction and ensuring a seal between two members which undergo a relative rotation. Moreover, a second sealing element 34 having an X-shaped or like cross-section is disposed between the outer periphery of the ring 30 and the inner periphery of an annular member 35 fixed on a plate 36 which closes the opening 4 formed in the lateral wall of the machine. This plate 36 is fixed to the machine by means of clamps 37 and screws 38, preferably with interposition of elastically yieldable means (not shown).

The mounting of the lower rollers employs, for reasons of standardisation, most of the elements of the bearings of the upper rollers except for the elastically yieldable assembly, since the housing of the roller bears against a fixed support 39 which can be taken apart. Consequently it will not be described in detail and neither will be the motor-speed reducer units 40 for driving the rollers and protected by shields 41. Likewise, only the main elements of the arrangement according to the invention have been described since it is unnecessary to mention in detail the various joints, relief valves, greasing means etc. which are employed but are well known in the art.

1. A device for mounting rollers in a metal sheet treating machine, and in particular a cooling machine, the machine comprising a lower frame and an upper frame and a series of rollers carried by each frame, said device comprising:

for each end of each roller of at least one series of rollers, a bearing, a support carrying the bearing, and elastically yieldable means connecting the support to the corresponding frame and allowing the bearing a vertical movement to a given extent relative to the corresponding frame;

for each bearing of the upper rollers, an element of the upper frame, a fork member suspended from the element of the upper frame, a pre-stressed elastically yieldable spacer means interposed between the element of the upper frame and the fork member, and a housing for the bearing fixed in the fork member;

the roller support comprising a housing in which the bearing is mounted, a first fork member in which the bearing housing is fixed, and a second fork member which is fixed relative to the corresponding frame of the machine, the first fork member being mounted in the second fork member.

2. A device as claimed in claim 1, wherein only the rollers carried by the upper frame are mounted by the device.

3. A device as claimed in claim 1, wherein each frame of the machine comprises lateral walls constituted by thick plates in which openings are provided for the passage of the rollers, and the bearings of the rollers and

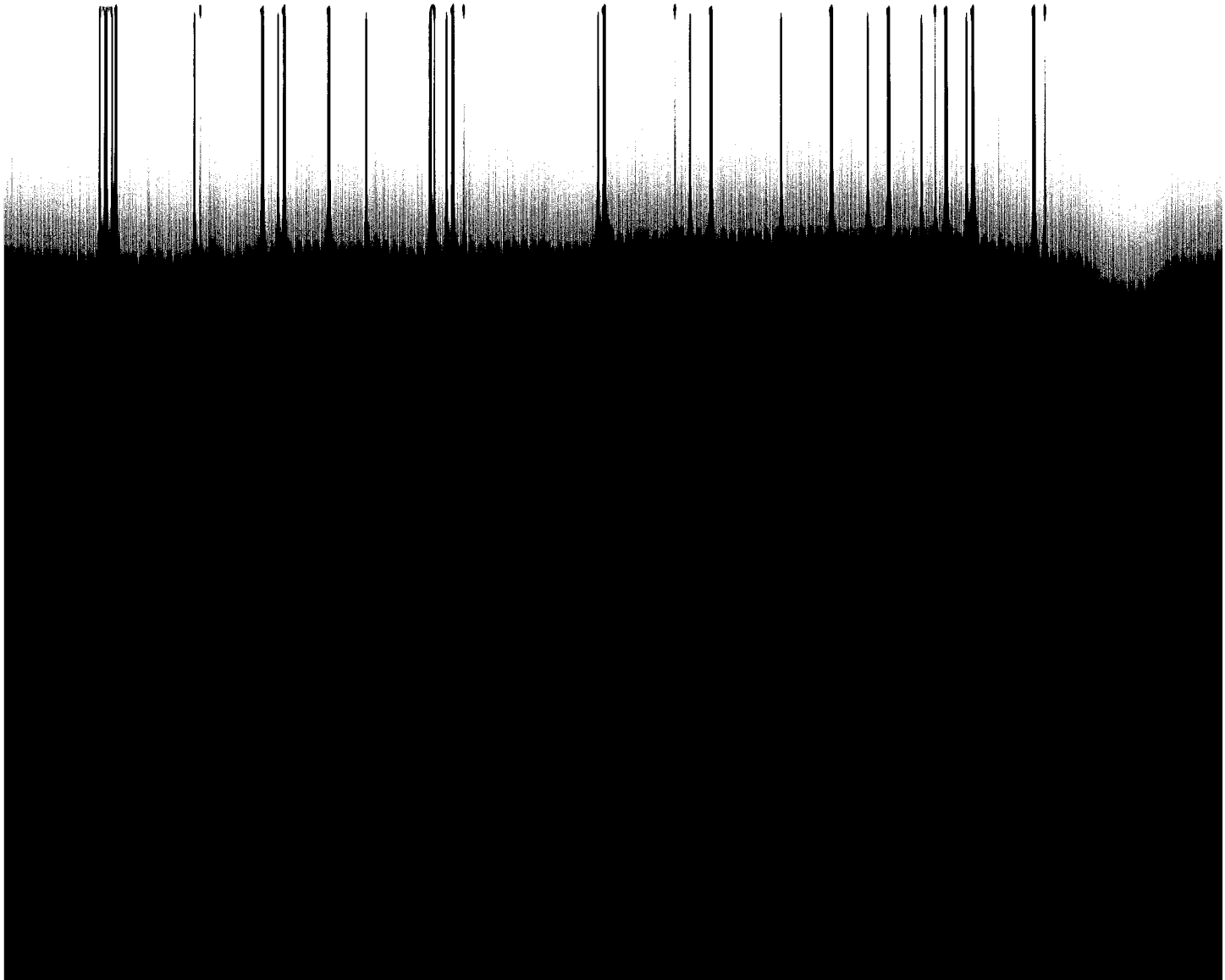

each roller has a journal, each bearing has a bearing housing and a ring is rigid with the housing and has a skirt which extends between the journal of the roller and said element rigid with the frame, and a sealing element capable of absorbing movements in translation is interposed between the skirt and said element rigid with the frame.

8. A device for mounting rollers in a metal sheet treating machine, and in particular a cooling machine, the machine comprising a lower frame and an upper frame and a series of rollers carried by each frame, said device comprising:

for each end of each roller of at least one series of rollers, a bearing, a support carrying the bearing, and elastically yieldable means connecting the support to the corresponding frame and allowing the bearing a vertical movement to a given extent relative to the corresponding frame;

only the roller carried by the upper frame being mounted by the device;

for each roller, two sealing devices, one of which sealing devices is disposed between the roller and an element rigid with the support and ensures the seal as concerns rotation of the roller, whereas the other of said sealing devices is disposed between said element rigid with the support and an element rigid with the corresponding frame and ensures the seal while being subjected to possible movements in translation of the roller and support.

9. The device of claim 8, wherein:

each roller has a journal, each bearing has a bearing housing and a ring is rigid with the housing and has a skirt which extends between the journal of the roller and said element rigid with the frame, and a sealing element capable of absorbing movement in translation is interposed between the skirt and said element rigid with the frame.

10. A device for mounting rollers in a metal sheet treating machine, and in particular a cooling machine, the machine comprising a lower frame and an upper frame and a series of rollers carried by each frame, said device comprising:

for each end of each roller of at least one series of rollers, a bearing, a support carrying the bearing, and elastically yieldable means connecting the support to the corresponding frame and allowing the bearing a vertical movement to a given extent relative to the corresponding frame;

each frame of the machine comprising lateral walls constituted by thick plates in which openings are provided for the passage of the rollers, and the bearings of the rollers and the associated supports being located outside the machine;

for each roller, two sealing devices, one of which sealing devices is disposed between the roller and an element rigid with the support and ensures the seal as concerns rotation of the roller, whereas the other of said sealing devices is disposed between said element rigid with the support and an element rigid with the corresponding frame and ensures the seal while being subjected to possible movements in translation of the roller and support.

11. The device of claim 10, wherein:

each roller has a journal, each bearing has a bearing housing and a ring is rigid with the housing and has a skirt which extends between the journal of the roller and said element rigid with the frame, and a sealing element capable of absorbing movements in translation is interposed between the skirt and said element rigid with the frame.

12. A device for mounting rollers in a metal sheet treating machine, and in particular a cooling machine, the machine comprising a lower frame and an upper frame and a series of rollers carried by each frame, said device comprising:

for each end of each roller of at least one series of rollers, a bearing, a support carrying the bearing, and elastically yieldable means connecting the support to the corresponding frame and allowing the bearing a vertical movement to a given extent relative to the corresponding frame;

for each bearing of the upper rollers, an element of the upper frame, a fork member suspended from the element of the upper frame, a pre-stressed elastically yieldable spacer means interposed between the element of the upper frame and the fork member, and a housing for the bearing fixed in the fork member;

for each roller, two sealing devices, one of which sealing devices is disposed between the roller and an element rigid with the support and ensures the seal as concerns rotation of the roller, whereas the other of said sealing devices is disposed between said element rigid with the support and an element rigid with the corresponding frame and ensures the seal while being subjected to possible movements in translation of the roller and support.

13. The device of claim 12, wherein:

each roller has a journal, each bearing has a bearing housing and a ring is rigid with the housing and has a skirt which extends between the journal of the roller and said element rigid with the frame, and a sealing element capable of absorbing movements in translation is interposed between the skirt and said element rigid with the frame.

* * * * *